US006722905B2

(12) United States Patent
Negishi et al.

(10) Patent No.: US 6,722,905 B2
(45) Date of Patent: Apr. 20, 2004

(54) BOARD CONNECTOR

(75) Inventors: Satoshi Negishi, Susono (JP); Yuji Hatagishi, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/353,024

(22) Filed: Jan. 29, 2003

(65) Prior Publication Data

US 2003/0148648 A1 Aug. 7, 2003

(30) Foreign Application Priority Data

Feb. 4, 2002 (JP) ..... P2002-026950

(51) Int. Cl.[7] ..... H01R 13/15
(52) U.S. Cl. ..... 439/260; 439/495
(58) Field of Search ..... 439/260, 261, 439/265, 266, 267, 492, 495

(56) References Cited

U.S. PATENT DOCUMENTS 4,334,728 A * 6/1982 Reynolds et al. ..... 439/267
5,580,272 A * 12/1996 Yamaguchi et al. ..... 439/495
5,624,281 A * 4/1997 Christensson ..... 439/729
5,904,586 A * 5/1999 Takayasu ..... 439/260
5,906,498 A * 5/1999 Nagafuji ..... 439/260
6,352,442 B1 * 3/2002 Kudo ..... 439/260
6,431,897 B1 * 8/2002 Hashiguchi et al. ..... 439/267
6,514,101 B1 * 2/2003 Miura ..... 439/495

FOREIGN PATENT DOCUMENTS

JP 9-82427 3/1997

* cited by examiner

*Primary Examiner*—Tulsidas Patel
(74) *Attorney, Agent, or Firm*—Sughrue Mion, PLLC

(57) ABSTRACT

A board connector for fixing a printed circuit board on which a conductor circuit is formed includes a first connector housing, a second connector housing, an operating lever and an auxiliary lever. The first connector housing, accommodating a plurality of first terminals therein. The second connector housing, accommodating a plurality of second terminals therein, and provided above the first connector housing. The operating lever, pivotably coupled to the first connector housing and the second housing for moving the first connector housing and the second connector to closer each other between a first position and a second position. The auxiliary lever, pivotably coupled to the operating lever and the first connector housing for restricting the pivotal range of the operating lever. The first connector housing and the second connector housing have a space for inserting end portions of the printed circuit board therebetween when the operation lever is located in the first position. The printed circuit board is secured between the first connector housing and the second connector housing when the operation lever is located in the second position.

8 Claims, 6 Drawing Sheets

27...PROJECTED PORTION

39...SLIDE PIN

46...SLOT

10...BOARD CONNECTOR
11...CONNECTOR HOUSING
15...FIXED-SIDE HOUSING (FIRST HOUSING)
25...MOVABLE-SIDE HOUSING (SECOND HOUSING)
16, 26...OUT WALLS (WALL PORTIONS)
35...OPERATING LEVER
38b...NOTCH
45...AUXILIARY LEVER

30...LATCHING WALL 40a, 40b...MATING HOLES (COUPLING PORTIONS)

60...PRINTED CIRCUIT BOARD

65...INSULATING BOARD

75...WIRING CONDUCTOR

27...PROJECTED PORTION

39...SLIDE PIN

46...SLOT

55...TERMINAL FITTINGS (TERMINALS)

57...ELASTIC CONTACT PORTION

PRIOR ART

BOARD CONNECTOR

BACKGROUND OF THE INVENTION

The present invention relates to a board connector contained in an electric connection box and fixed to a wiring board forming an internal circuit of the electric connection box with zero insertion force.

Heretofore, junction boxes and electric connection boxes are employed for supplying power to electric equipment, exchange signals among electronic parts and make internal circuits branch off intensively around automotive engine rooms and instrument panels.

In some electric connection box, there are installed a printed circuit board mounted with a fuse, a relay, a connector or the like and a wiring board with a conductor circuit forming an internal circuit formed thereon, whereas the junction box is equipped with the wiring board and a board connector connected to the wiring board. However, as the term 'junction box' may be used to collectively mean a junction box inclusive of an electric connection box sometime, the term 'electric connection box' is used to collectively mean such an electric connection box in this specification.

The electric connection box contains one sheet of wiring board or a plurality of laminated wiring boards formed with conductor circuits, the number of which depends on the kind or specification of the vehicle. A board connector is connected to the edge portion or onto the surface of the wiring board so as to supply power to electric equipment or exchange signals between electronic parts.

FIG. 7 shows the art related to a board connector of the sort stated in JP-A 9-82427. A board connector 80 includes a connector housing 81, first and second terminals 85 and 86 contained in the connector housing 81, and a lever 87. The connector housing 81 includes a board portion 82 and a side wall portion 84 provided on both sides of the board portion 82 with the upper portion of the board portion 82 open. Further, a number of slits 83*a* and 83*b* respectively cut out from both the front and back are formed in the board portion 82.

The first and second terminals 85 and 86 are long enough not to more or less overlap each other in the width direction of the connector housing 81 with the terminals 85 and 86 incorporated therein, whereby the positions of the adjoining first and second terminals 85 and 86 are arranged alternately in the longitudinal and width directions of the connector housing 81.

The lever 87 is pivotably supported above the connector housing 81 and by pivoting the lever 87 in the horizontal direction, a wiring board 88 can be press-fixed to the wiring board 88. More specifically, mating portions (not shown) curved toward the pivotal center of the lever are provided and the mating portions are mated with the front ends of the elastic support pieces (not shown) of the second terminals whereby to support the lever 87 pivotably on the front ends of the elastic support pieces.

Further, protrusions 87*a* are provided on the front-end side faces of the lever 87 and when the lever is pivoted in the horizontal direction, the protrusions 87*a* are fitted in the respective depressions 84*a* of the side wall portions 84 of the connector housing 81, so that the lever 87 is prevented from being easily released.

Many terminal portions (not shown) electrically contacting the board connector 80 are provided in longitudinally two rows on the back of the wiring board 88 and when the terminal portions in the front row are brought into contact with the contacts 86*a* of the second terminals 86, the terminal portions in the back row are brought into contact with the contacts 85*a* of the first terminals.

With the arrangement above, as the high-density arrangement of the terminals 85 and 86 is possible, the pitch of the adjoining terminals 85 and 86 is narrowed, so that the size of the connector becomes reducible.

However, there are following problems to be solved in the case of the related board connector.

Recently, with an increase in the number of electric devices and electronic parts to be loaded in automobiles, spaces available for installation of these electric and electronic components around engine rooms and instrument panels tend to become smaller, whereupon it is requested to make electric connection boxes smaller in size. On the other hand, the number of signal lines for exchanging signals among electronic parts is on the increase and there develops a demand for high-density conductor circuits and multi-pole board connectors.

The related board connector 80 described above is intended to narrow the pitch of the terminals 85 and 86 by arranging the adjoining terminals 85 and 86 in longitudinally two planar rows. However, the board connector 80 is applicable to only the single-sided wiring board but not so structured as to be applicable to a wiring board having a terminal portion formed on both sides of the board.

Further, the board connector 80 is not applicable to the wiring board 88 having the terminal portion formed on both sides of the board because it is to be fixed to one end edge portion of the wiring board 88. More specifically, the wiring conductors forming the conductor circuit are also not applicable to the wiring board for forming the terminal portions by drawing out the wiring conductors to both the adjoining portions of the wiring board.

Moreover, though the wiring board 88 is press-fixed to the board connector 80 by pivoting the lever 87 of the board connector 80, there is the possibility of letting the wiring board 88 slip out of the board connector 80 in case where tensile force inadvertently acts on the wiring board 88.

SUMMARY OF THE INVENTION

It is therefore an object of the present invention to provide a board connector which is applicable to a wiring board formed with a conductor circuit formed on both sides of the wiring board to ensure that terminals are multi-polarized with their highly reliable electrical connections to the wiring board and is joined to the wiring board with zero insertion force.

In order to achieve the above object, according to the present invention, there is provided a board connector for fixing a printed circuit board on which a conductor circuit is formed, comprising:

- a first connector housing, accommodating a plurality of first terminals therein;
- a second connector housing, accommodating a plurality of second terminals therein, and provided above the first connector housing;
- an operating lever, pivotably coupled to the first connector housing and the second housing for moving the first connector housing and the second connector to closer each other between a first position and a second position; and
- an auxiliary lever, pivotably coupled to the operating lever and the first connector housing for restricting the pivotal range of the operating lever;

wherein the first connector housing and the second connector housing have a space for inserting end portions of the printed circuit board therebetween when the operation lever is located in the first position; and wherein the printed circuit board is secured between the first connector housing and the second connector housing when the operation lever is located in the second position.

In the above configuration, the connector housing is divided into first housing and the second housing and both the housings are coupled to the operating lever. Thus, the print circuit board is fitted in between both the housing with zero insertion force without rubbing against both the housings and held between both the housing by pivoting the operating lever. As the first housing is provided with the auxiliary lever, the operating lever is supported by the auxiliary lever and the pivotal angle of the operating lever is controllable. Therefore, the printed circuit board can be fitted in the board connector with zero insertion force, so that the terminal portions and the like can be prevented from being deformed and damaged. Moreover, the operability of the operating lever is improved, whereby the printed circuit board and the board connector can easily be combined together.

Preferably, the operating lever includes an operating portion and a pair of arms extended from both ends of the operating portion, and each arm has coupling portions pivotably coupling to the first connector housing and the second connector housing respectively, and the operating portion has a plug-in portion slidably coupled to the auxiliary lever.

In the above configuration, the operating portion is provided with the plug-in portion slidably coupled to the auxiliary lever and the arms are provided with the coupling portions coupled to the connector housing, whereby the operating lever and the auxiliary lever are smoothly operated and the pivoting of the operating lever is controllable. Moreover, both the housings are moved in a manner interlocking with the pivoting of the arms so as to move both the housing closer to each other. Therefore, the operability of the operating lever is improved and the printed circuit board can be fitted in the board connector with zero insertion force.

Preferably, the plug-in portion has a notch and a slide pin provided on an inner face of the notch, and the auxiliary lever has a slot engaged with the slide pin.

In the above configuration, as the plug-in portion has the notch and the slide pin and the auxiliary lever has the slot mating with the slide pin, the operating lever and the auxiliary lever are slidably coupled and the slide pin is reciprocated in the slot in a manner interlocking with the pivoting of the operating lever. Therefore, the operating lever is pivotably supported by the auxiliary lever and this results in improving the stability of the operation of the operating lever.

Preferably, a portion near the first connector housing and the second connector housing side of the auxiliary lever is a L shaped portion, and portions near the first connector housing and the second connector housing side of the arms are L shaped portions.

In the above configurations, the auxiliary lever and the arms are folded and lie on top of another when the operating lever is pushed down so as to fix the board connector to the wiring board. Consequently, the auxiliary lever and the arms are prevented from sticking out and interfering with the outside.

Preferably, a pair of guiding walls are provided on the second connector housing to restrict a pivotal direction of the auxiliary lever, and the auxiliary lever is positioned between the guiding walls.

In the above configuration, as the guiding walls for holding the auxiliary lever are provided in the second housing, the second housing and the auxiliary lever are positioned properly as the former and the latter are restricted mutually. Consequently, the positional deviation of the board connector is prevented with respect to the terminals of the printed circuit board, so that the reliability of the electrical connections is improved.

Preferably, the first terminals are accommodated in a first terminal chambers provided in the first connector housing, and the second terminals are accommodated in a second terminal chambers provided in the second connector housing. The first terminals and second terminals are arranged so as to connected to terminal portions of the conductor circuit, the terminal portions formed on both sides of the printed circuit board when the operation lever is located in the second position.

In the above configuration, the terminals contained in the terminal chambers are positioned in vertical two rows and electrically connected to the terminal portions formed on both sides of the printed circuit board. It is therefore possible to have the terminals multi-polarized and provide a high-density internal circuit as the multi-polarized terminals are brought into contact with the terminal portions of the printed circuit board with the conductor circuit formed on both sides of the printed circuit board.

Preferably, latch portions, respectively engaged with engagement portions which are provided on the printed circuit board, are provided on the second connector housing.

In the above configuration, the engagement portions of the printed circuit board are joined to the latch portions of the housing before being fixed to the insulating board after the wiring board is held by the board connector to ensure that the wiring board is prevented from slipping out. Thus, the reliability of the electrical connections is improved.

BRIEF DESCRIPTION OF THE DRAWINGS

The above objects and advantages of the present invention will become more apparent by describing in detail preferred exemplary embodiments thereof with reference to the accompanying drawings, wherein:

FIG. 6A shows the board connector in a condition before the board connector makes contact with the wiring board and FIG. 6B shows after the board connector makes contact therewith.

DETAILED DESCRIPTION OF THE PREFERRED EMBODIMENTS

A detailed description will now be given of an embodiment of the invention with reference to the drawings. FIGS. 1 to 6 show a board connector embodying the invention.

Figure 1:
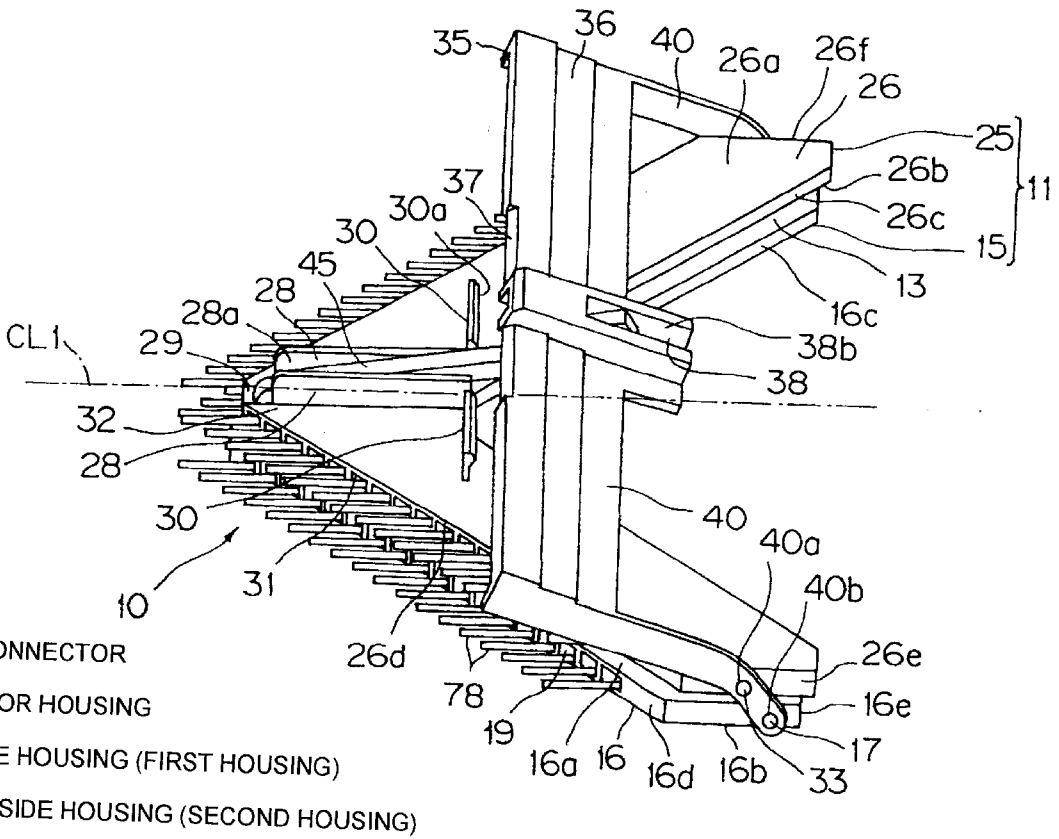
FIG. 1 shows a perspective view of a board connector embodying the invention.

A board connector 10 shown in FIG. 1 is applied to a printed circuit board (wiring board) 60 with a conductor circuit formed on both the front and back of the printed circuit board and used for exchanging signals between electronic parts.

The board connector 10 includes a connector housing 11, a plurality of terminal fittings (terminals) 55 housed in the terminal holding chambers 19 and 31 of the connector housing 11, an operating lever 35 coupled to the outer walls (wall portions) 16 and 26 of the connector housing 11, and an auxiliary lever 45 slidably coupled to the operating lever 35. The connector housing 11, the operating lever 35 and the auxiliary lever 45 are formed of synthetic resin or the like by injection molding. The terminal fittings 55 (see FIG. 6) are formed of conductive metal and made by punching terminal fittings from a sheet of metal and bending the punched ones.

The connector housing 11 essentially consists of two vertically divided housings including a fixed-side housing 15 and a movable-side housing 25. Both housings 15 and 25 are L-shaped in top plan view and formed in well-balanced bilateral symmetry with respect to a dividing line CL1 passing a corner portion 32.

A mating space 13 for receiving the printed circuit board 60 is formed between the fixed-side housing 15 and the movable-side housing 25. The mating space 13 has an opening greater in dimension than the thickness of the printed circuit board 60 so that the printed circuit board 60 can be fitted in the connector housing 11 with zero insertion force. After the printed circuit board 60 is fitted in the printed circuit board 60, both housings 15 and 25 are set closer to each other by tilting the operating lever 35 downward as will be described later, whereby the printed circuit board 60 is held therebetween.

For convenience of explanation, the front and back, the top and bottom of the connector housing 11 are distinguished from one another as follows. The front is the side where the printed circuit board 60 is fitted in and the back is the side where electric wires 78 are drawn out. The operating lever 35 and the auxiliary lever 45 are placed on the upper side, whereas the lower side is opposite thereto. Further, though the lateral direction is the direction in which the operating lever 35 is coupled to the outer walls 16 and 26, the left side is not to be distinguished from the right side as the connector housing 11 is in lateral symmetry.

The outer walls 16 and 26 of both housings 15 and 25 have upper and lower walls 16*a*, 16*b*, 26*a* and 26*b*, front walls 16*c* and 26*c* joined to the printed circuit board 60, rear walls 16*d* and 26*d* from which the electric wires 78 connected to the terminal fittings 55 are drawn out and side walls 16*e*, 16*f* (not shown), 26*e* and 26*f* on both sides. The terminal holding chambers 19 and 31 are arranged so as to pass longitudinally through the terminal holding chambers 19 and 31 in both the fixed-side housing 15 and the movable-side housing 25. A pair of upright walls 28 are formed on the upper wall 26*a* of the movable-side housing 25 and latching walls 30 bent in a direction perpendicular to a extending direction of the upright walls are coupled to the adjoining end portions of the respective upright walls 28.

A projected portion (latching portion) 27 (see FIG. 4) mating with each cut portion (mating portion) 69 (see FIG. 3) of the printed circuit board 60 is provided on both sides of the lower wall 26*b* of the movable-side housing 25. The cut portion 69 is provided in a pair of opposed corner portions 68*c* and 68*d* of the printed circuit board 60. In this case, the projected portions may be provided on the printed circuit board 60, whereas the cut portions may be provided in the movable-side housing 25.

As the terminal holding chambers 19 and 31 are provided in the respective housings 15 and 25, the connector housing 11 as a whole is arranged over the terminal holding chambers 19 and 31 in a double deck form. The terminal holding chambers 19 and 31 are separated from each other by a partition wall (not shown) so that the adjoining terminal fittings 55 are prevented from shorting.

The terminal fittings 55 equal in number to the terminal portions 76 (see FIG. 3) of the printed circuit board 60 are housed in the plurality of terminal holding chambers 19 and 31. The upper and lower terminal holding chambers 19 and 31 are arranged alternately so as to correspond to the terminal portions 76 of the printed circuit board 60, whereby the terminal fittings 55 are connected to the terminal portions 76 on a one-to-one footing.

As shown in FIG. 1, the terminal holding chambers 19 and 31 positioned in bilateral symmetry with the dividing line CL1 held therebetween are directionally matched. In other words, the terminal holding chambers 19 and 31 are arranged in the same direction. The direction in which the terminal holding chambers 19 and 31 are depend on the dividing line CL1, that is, in a 45° direction according to this embodiment of the invention. This is because the board connector 10 according to this embodiment of the invention is applied to the square printed circuit board 60 shown in FIG. 2 or 3 and because the direction of the diagonal line CL2 of the printed circuit board 60 is equal to the 45° direction. Consequently, the direction in which the terminal holding chambers 19 and 31 are led also changes as the shape of the printed circuit board 60 changes. In case where the printed circuit board 60 is rectangular or parallelogrammic, because the diagonal line CL2 thereof is not led in the 45° direction, the direction of the terminal holding chambers 19 and 31 may be led in a direction smaller or greater than the 45° direction.

The pair of upright walls 28 are provided along the dividing line CL1 in the corner portion 32 of the movable-side housing 25. The inner wall surface 28*a* of the upright wall 28 is formed on the same plane as the groove wall surface 29 of a slot 29 provided in a depressed condition. In other words, the provision of the pair of upright walls 28 serves to increase the length of the slot 29 in the vertical direction to ensure that the auxiliary lever 45 is restrained by both the walls as will be described later.

The latching walls 30 are linked with the front end portions of the upright walls 28 and uprightly formed with respect to the dividing line CL1 and also formed in parallel to the operating portion 36 of the operating lever 35 as will be described later. A pawl portion 30*a* mating with the tapered portion 37 of the operating portion 36 is formed on each latching wall 30 and along the upper end portion of the latching wall 30, so that the latched condition of the operating lever 35 is prevented from being released by making the pawl portion 30*a* mate with the tapered portion 37 of the operating lever 35.

The operating lever 35 essentially consists of a pair of arms 40 extended from both sides of the operating portion 36, which is a flat plate member extending in a direction perpendicular to the dividing line CL1. A plug-in portion 38 for the auxiliary lever 45 is provided in the central portion of the operating portion 36.

Figure 4:
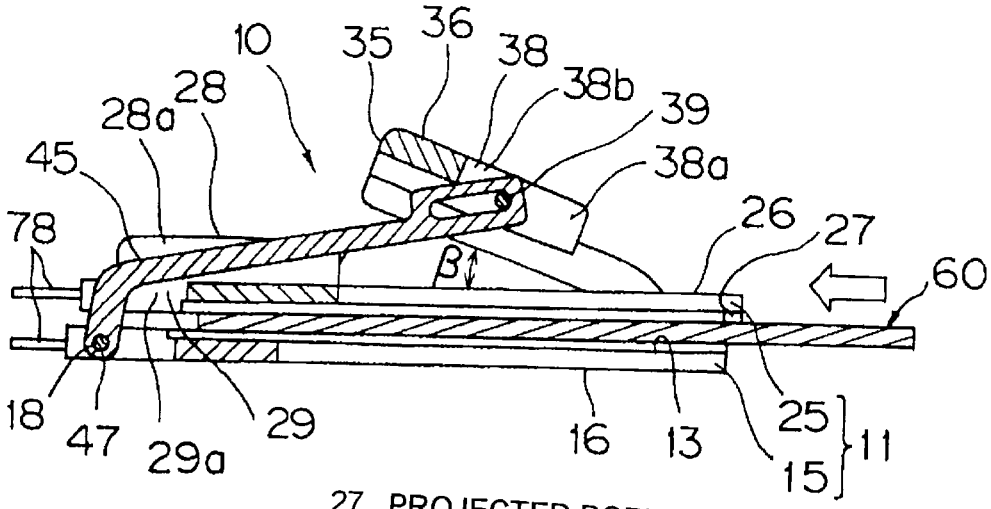
FIG. 4 shows a sectional view of the vicinity of the central portion when the operating lever of the board connector is raised.
Figure 5:
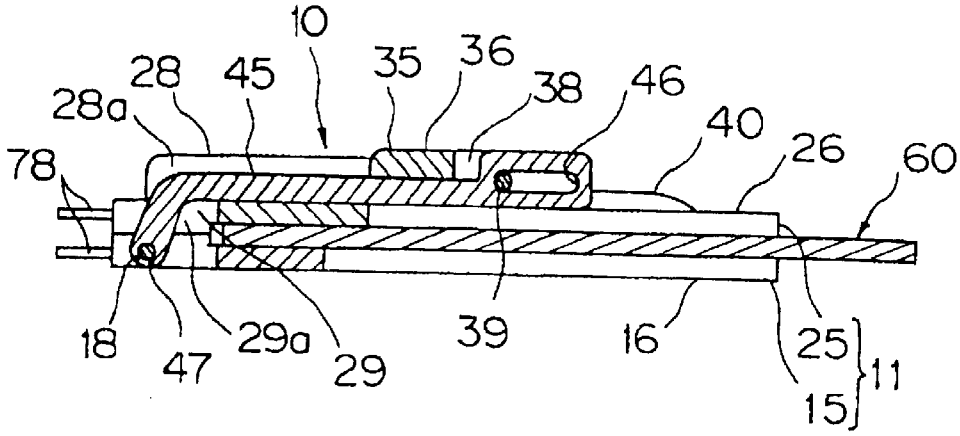
FIG. 5 shows a sectional view of the vicinity of the central portion when the operating lever of the board connector is pushed down.

The plug-in portion 38 has a notch 38*b* and a slide pin 39 projected from the inner walls 38*a* of the notch 38*b* (see FIGS. 4 and 5). A framelike slot 46 formed at the other end of the auxiliary lever 45 is slidably coupled to the slide pin 39. As the slot 46 of the auxiliary lever 45 is coupled to the slide pin 39, the operating lever 35 is pivotably supported and the pivotal direction of the operating lever 35 is restricted so that the operability of the operating lever 45 is improved.

The arms 40 are pivotably coupled to the outer walls 16 and 26 of the connector housing 11 in a diagonal slidable condition via mating holes 40*a* and 40*b*. More specifically, the arms 40 are coupled to pins 17 and 33 formed on the side walls 16*e*, 16*f*, 26*e* and 26*f* on both sides of the fixed-side housing 15 and the movable-side housing 25 via the pair of mating holes 40*a* and 40*b*. The first pins 17 (only one side is shown) are formed on the side walls 16*e* and 16*f* on both sides of the fixed-side housing 15 and the second pins 33 (only one side is shown) are formed on the side walls 26*e* and 26*f* on both sides of the movable-side housing 25. The front end side of each arm 40 is curved in L shape so that when the arm 40 is pushed down, the operating portion 36 is put on the top surface of the movable-side housing 25 in parallel.

FIG. 4 shows the raised condition of the operating portion 36, whereas FIG. 5 shows the pushed-down condition of the operating portion 36. When the arms 40 are pivoted with the first pins 17 as fulcrums, the second pins 33 draw an arcuate pivotal locus with the first pins 17 as reference points and the movable-side housing 25 is moved close to or away from the fixed-side housing 15. In other words, the arms 40 are made to lie down when the operating portion 36 is pushed down (see FIG. 5) and the movable-side housing 25 is moved closer to the fixed-side housing 15, so that the mating space 13 between both housings 15 and 25 is narrowed. When the operating portion 36 is raised (see FIG. 4), on the other hand, the arms 40 are also raised and the movable-side housing 25 is moved away from the fixed-side housing 15, so that the mating space 13 between both housings 15 and 25 is widened.

As shown in FIG. 4, the auxiliary lever 45 has a mating hole 47 on its one end side, the mating hole 47 being coupled to the third pin 18 of the fixed-side housing 15 in a diagonal slidable condition and the slot 46 slidably coupled to the operating lever 35 on the other end side. The slot 46 of the auxiliary lever 45 is in the form of a frame and the slide pin 39 of the operating portion 36 is fitted and reciprocated in the frame in a manner interlocking with the pivoting of the operating lever 35. Moreover, a portion of the auxiliary lever 45 on the board coupling side is convexly curved and when the operating lever 35 is pushed down, the auxiliary lever 45 is put on the top surface of the movable-side housing 25 in parallel.

When the operating lever 35 is raised, the slide pin 39 is brought into contact with one side of the slot 46 and as the operating lever 35 becomes unable to be raised further, the pivoting range of the operating lever 35 is thus restricted. In this condition, the printed circuit board 60 can be fitted in or removed. When the operating lever 35 is pushed down, on the other hand, the slide pin 39 is caused to slide toward the opposite side of the slot 46 whereby to put the auxiliary lever 45 and the operating lever 35 on top of each other. In this condition, the printed circuit board 60 is held between both housings 15 and 25. The dimensions of the slot 46 are optional and by changing the dimensions thereof, the pivotal angle β (pivotable range) of the operating lever 35 can be varied.

Figure 2:
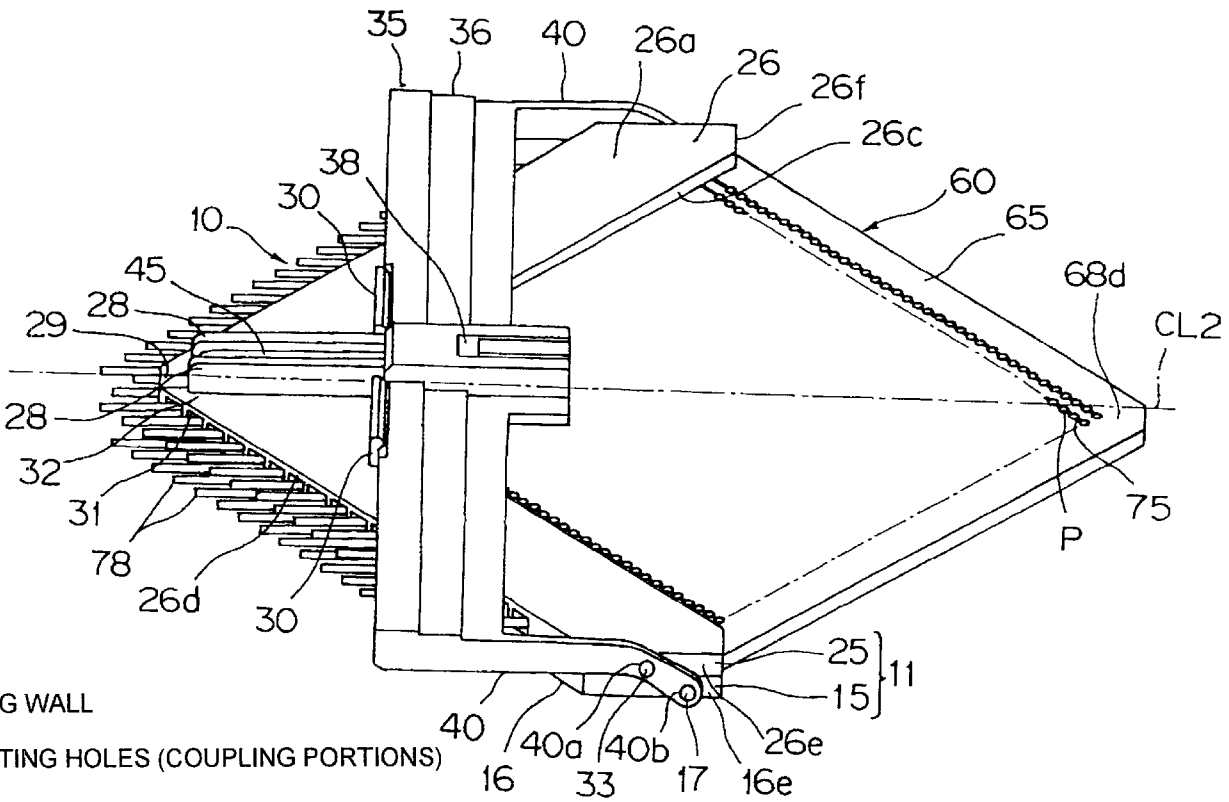
FIG. 2 shows a perspective view of a condition in which a wiring board is fitted in the board connector shown in FIG. 1.

FIG. 2 shows a condition in which the printed circuit board 60 has been fitted in the board connector 10. The printed circuit board 60 is fitted in the mating space 13 (see FIG. 1) between both housings 15 and 25 with zero insertion force and brought into contact with the back wall so that the positioning of the direction of insertion is determined. Then the projected portions 27 are mated with the cut portions 69 of the printed circuit board 60 by pushing down the operating lever 35 and the printed circuit board 60 is vertically held between both housings 15 and 25. The operating lever 35 is latched onto the pawl portions 30*a* of the latching walls 30 so as to prevent the operating lever 35 from being inadvertently raised. In the fitted condition above, the terminal fittings 55 and the terminal portions 76 remain mutually connected.

Figure 3:
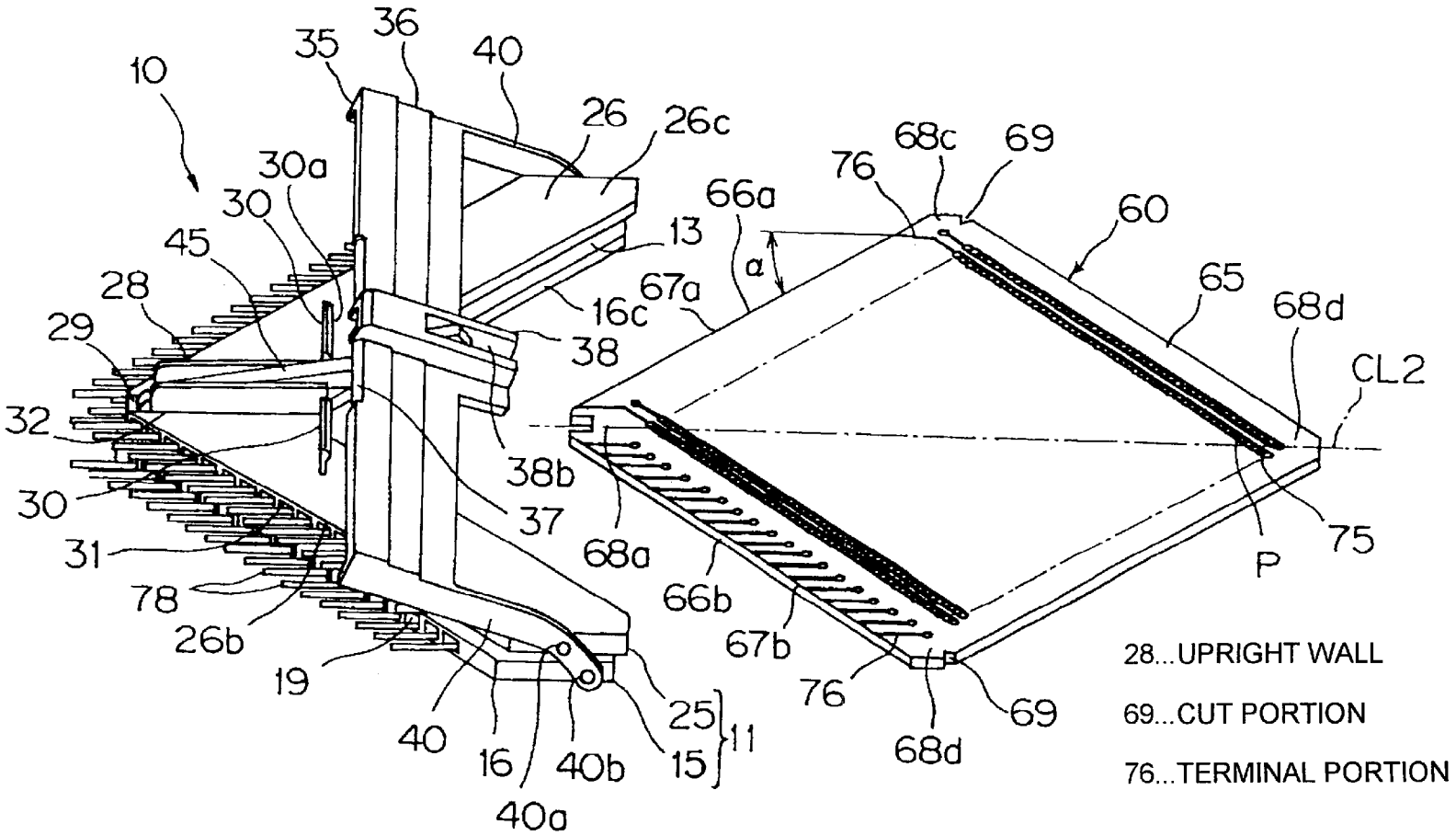
FIG. 3 shows a perspective view of a condition in which the wiring board is removed from the board connector.

FIG. 3 shows the board connector 10 in such a condition that the printed circuit board 60 has been removed. When the printed circuit board 60 is removed, it is only needed to reverse the components assembly operation above. More specifically, while the latching walls 30 are being warped so as to release the latched condition of the operating lever 35, the operating lever 35 is raised so as to release the projected portions 27 from latching the cut portions 69 and the printed circuit board 60 is pulled out, whereupon the removing operation is easily performed.

Figure 6A:
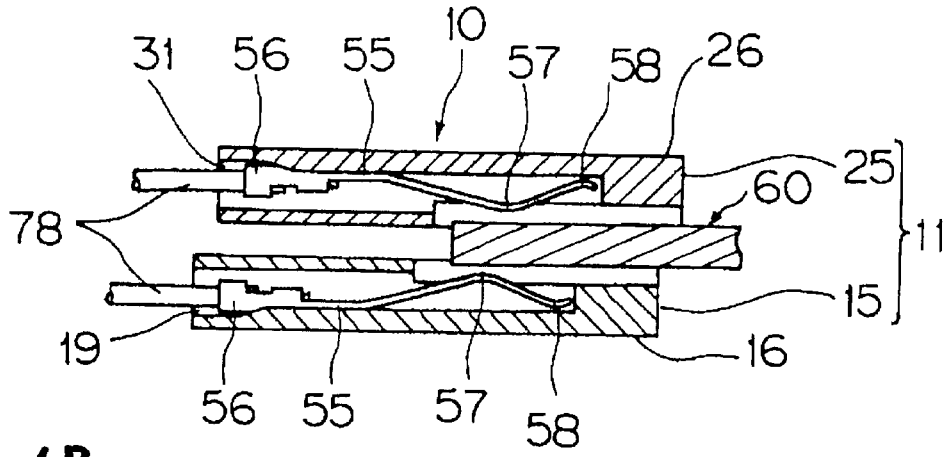
FIGS. 6A and 6B shows sectional views of the board connectors.
Figure 6B:
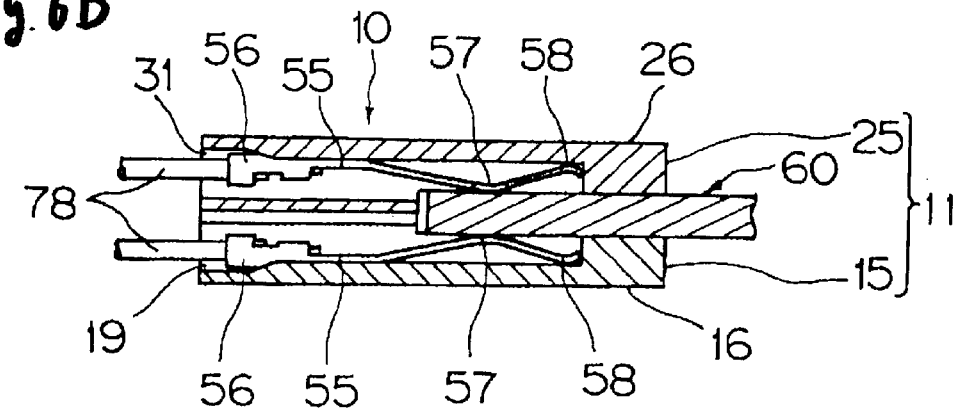
Figure 7:
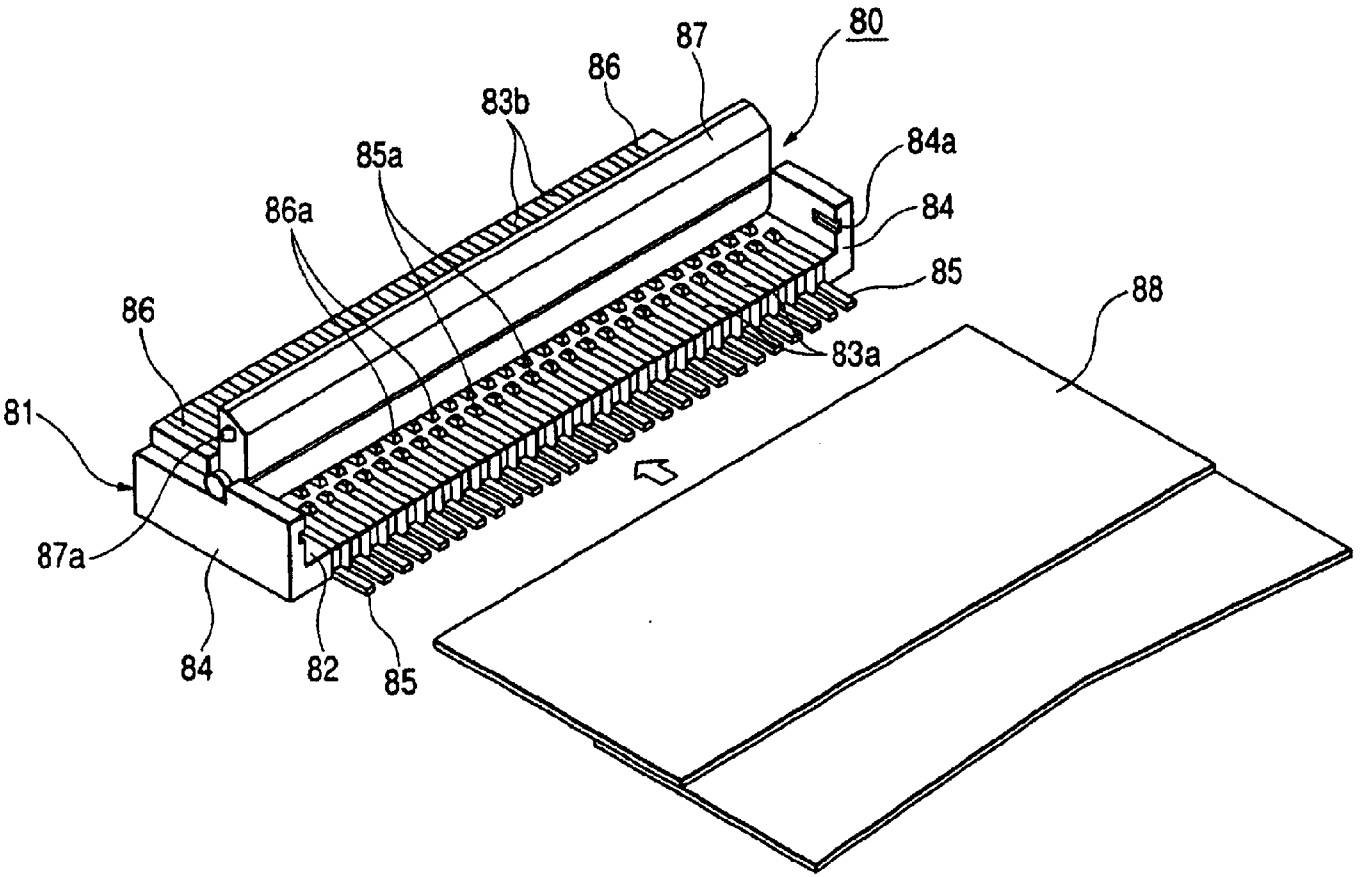
FIG. 7 shows a perspective view of an example of a related board connector.

As shown in FIG. 6, the terminal fittings 55 with the electric wires 78 are extending in the mating space 13 (see FIG. 3, etc.) between both housings 15 and 25. The terminal fittings 55 are arranged vertically in the upper and lower terminal holding chambers 19 and 31 so that convexly curved elastic contact portions 57 are opposite to one another. Although the gap between the facing elastic contact portions 57 is set wider than the thickness of the printed circuit board 60 as shown in FIG. 6A, the gap therebetween is narrowed when the operating lever 35 (see FIG. 1, etc.) is pushed down as shown in FIG. 6B and the terminal portions 76 (FIG. 3) on both sides of the printed circuit board 60 rub against the respective upper and lower elastic contact portions 57 and contact one another.

The terminal fittings 55 are formed by punching terminal fittings from a conductive board and bending the punched ones. An electric-wire connecting portion 56 is formed on one side of each of the terminal fittings 55, whereas a tab-like front end portion 58 is formed on the other side thereof, the curved elastic contact portion 57 being formed integrally therewith between the electric-wire connecting portion 56 and the tab-like front end portion 58.

The electric-wire connecting portion 56 has a conductor caulking portion for caulking a conductor and a covered-wire caulking portion for caulking a covered wire and is formed with a pair of pressure-welding pieces. The elastic contact portion 57 is a contact portion for causing the internal circuit to conduct by contacting the terminal portion 76, so that suitable contact pressure is maintained by making use of its curved configuration so as to resiliently contact the terminal portion 76.

The tab-like front end portions 58 are inserted into the holes (not shown) of the terminal holding chambers 19 and 31 and fixed lest the tab-like front end portions 58 are moved. Mating holes (not shown) are provided in the terminal fittings 55 and by mating with the mating projections (not shown) of the terminal holding chambers 19 and 31, prevented from rearwardly slipping out. Incidentally, the terminal fittings 55 may be provided with the mating projections and the terminal holding chambers 19 and 31 may be provided with the mating holes.

The printed circuit board 60 shown in FIGS. 2 and 3 will be provided briefly hereinbelow. The printed circuit board 60 is in the form of a flat rectangular board and formed by printing wiring conductors 75 integrally on an insulating board 65 made of organic material such as epoxy resin or the like. Although the printed circuit board 60 will be described according to this embodiment of the invention, such a circuit board may be formed by insert-molding or bonding thin wiring conductors 75 on the insulating board 65. Moreover, conductive resin material may be applicable to the wiring conductors 75.

The printed circuit board 60 is a so-called double sided printed circuit board having a conductor circuit on both sides. In comparison with a single-sided printed circuit board, not only is the number of wiring conductors on the double sided printed circuit board doubled but also complicated wiring that needs cross wiring is easily formable.

The printed conductor circuit is formed with the parallel wiring conductors 75 arranged regularly with a predetermined pitch. Due to the fact that a very small current for a signal of a several-millimeter ampere flows through the wiring conductors 75, it is unlikely that the wiring conductors 75 are broken by fusion.

The conductor circuit is printed on both sides of the printed circuit board so that the two circuits are made solidly alternate with each other. The conductor circuit on the surface side forms a conductor circuit in the line direction, whereas the conductor circuit on the undersurface side forms a conductor circuit in the column direction. In other words, the wiring conductors 75 forming both the conductor circuits are subjected to solidly cross wiring.

The lattice points P of the wiring conductors 75 thus subjected to the cross wiring are lined up regularly in the form of a matrix. A through-hole passing through the printed circuit board is formed at each lattice point P. As the through-hole itself is not conductive, the wiring conductors 75 on both sides are not directly and electrically connected together. There are various methods of electrically connecting the wiring conductors 75 and one of them is to form conducting paths for signals by selectively forming a pass-through conductor in each through-hole as the lattice point P. The pass-through conductor may be a hollow pass-through conductor plated with conductive metal or a solid pass-through conductor such a rivet pin or a wire.

The wiring conductors 75 on both sides of the printed circuit board are mutually connected together via the pass-through conductors, whereby an exchange of signals can freely be carried out between electric devices or electronic parts. In other words, it is possible to form a flexible internal circuit because connection ports on input and output signal sides can freely be selected and because an exchange of input and output signals can also be carried out without being restricted by conducting paths.

The terminal portions 76 connected to the terminal fittings 55 housed in the L-shaped board connector 10 are formed in the edge portions 66*a* and 66*b* (see FIG. 3) of the printed circuit board 60. The terminal portions 76 are equivalent to terminal portions of the respective wiring conductors 75 constituting the conductor circuits and drawn out to the adjoining edge portions 66*a* and 66*b* of the printed circuit board 60. The number of poles of the input and output signals is increased by drawing out the terminal portions 76 from the edge portions 66*a* and 66*b* on the two sides, so that many of electric devices can be controlled simultaneously and electronically. In this case, these positions on the input and output sides are not restricted in particular and can selectively be assigned in either edge portion 66*a* or 66*b* on the two sides.

The terminal portions 76 are formed on both sides of the printed circuit board so that they are made to solidly alternate with each other. The pitch of 20 the terminal portions 76 thus alternately arranged is set at ½ time the pitch of the wiring conductors 75. In other words, it is made possible to provide multiconductor (multi-pole) terminal portions 76 by arranging the terminal portions 76 drawn out to the edge portions 66*a* and 66*b* of the printed circuit board 60 alternately in the vertical two of upper and lower rows.

The terminal portions 76 are unidirectionally drawn out at a tilted angle α (see FIG. 3) of 45° with respect to the ridgelines 67*a* and 67*b* of the edge portions 66*a* and 66*b*. The reason for drawing out the terminal portions 76 unidirectionally is that the adjoining edge portions 66*a* and 66*b* of the printed circuit board 60 are simultaneously incorporated into the L-shaped board connector 10.

Although it is possible to incorporate the edge portions 66*a* and 66*b* of the printed circuit board 60 separately by dividing out the L-shaped board connector 10, the terminal portions 76 need not be tilted in the 45° direction but the terminal portions 76 may be drawn out in a direction perpendicular to the ridgelines 67*a* and 67*b* of the edge portions 66*a* and 66*b*. In the case of using the L-shaped board connector 10, the advantage is that assembly workability is made improvable by simultaneously mating both the edge portions 66*a* and 66*b* of the printed circuit board 60 together.

The reason for setting the tilted angle α of the terminal portions 76 is that the printed circuit board 60 according to this embodiment of the invention is square in shape and that the diagonal line CL2 connecting the opposed corner portions 68*a* and 68*d* is in the 45° direction.

Not only the board connector 10 according to this embodiment of the invention but also what has been applied for patent separately is applicable to the printed circuit board 60 thus having the conductor circuit on both sides of the board.

What is claimed is:

1. A board connector for fixing a printed circuit board on which a conductor circuit is formed, comprising:

a first connector housing, accommodating a plurality of first terminals therein;

a second connector housing, accommodating a plurality of second terminals therein, and provided above the first connector housing;

an operating lever, pivotably coupled to the first connector housing and the second housing for moving the first connector housing and the second connector to closer each other between a first position and a second position; and an auxiliary lever, pivotably coupled to the operating lever and the first connector housing for restricting the pivotal range of the operating lever;

wherein the first connector housing and the second connector housing have a space for inserting end portions of the printed circuit board therebetween when the operation lever is located in the first position; and wherein the printed circuit board is secured between the first connector housing and the second connector housing when the operation lever is located in the second position.

2. The board connector as set forth in claim 1, wherein the operating lever includes an operating portion and a pair of arms extended from both ends of the operating portion;

wherein each arm has coupling portions pivotably coupling to the first connector housing and the second connector housing respectively; and wherein the operating portion has a plug-in portion slidably coupled to the auxiliary lever.

3. The board connector as set forth in claim 2, wherein the plug-in portion has a notch and a slide pin provided on an inner face of the notch; and wherein the auxiliary lever has a slot engaged with the slide pin.

4. The board connector as set forth in claim 1, wherein a portion near the first connector housing and the second connector housing side of the auxiliary lever is a L shaped portion.

5. The board connector as set forth in claim 2, wherein portions near the both connector housings and the second connector housing side of the arms are L shaped portions.

6. The board connector as set forth in claim 1, wherein a pair of guiding walls are provided on the second connector housing to restrict a pivotal direction of the auxiliary lever; and wherein the auxiliary lever is positioned between the guiding walls.

7. The board connector as set forth in claim 1, wherein the first terminals are accommodated in a first terminal chambers provided in the first connector housing;

wherein the second terminals are accommodated in a second terminal chambers provided in the second connector housing; and wherein the first terminals and second terminals are arranged so as to connected to terminal portions of the conductor circuit, the terminal portions formed on both sides of the printed circuit board when the operation lever is located in the second position.

8. The board connector as set forth in claim 1, wherein latch portions, respectively engaged with engagement portions which are provided on the printed circuit board, are provided on the second connector housing.

* * * * *